US005215490A

United States Patent [19]

Szoradi

[11] Patent Number: 5,215,490

[45] Date of Patent: Jun. 1, 1993

[54] BUILDING BLOCK SET OF TENON ENGAGING EDGE CONNECTING MEMBERS

[75] Inventor: Charles A. Szoradi, 4321 Yuma St. NW., Washington, D.C. 20016

[73] Assignee: Charles A. Szoradi, Philadelphia, Pa.

[21] Appl. No.: 760,898

[22] Filed: Sep. 17, 1991

[51] Int. Cl.[5] ..... A63H 33/08

[52] U.S. Cl. ..... 446/115; 446/125

[58] Field of Search ..... 446/106, 108, 112, 113, 446/114, 115, 116, 120, 125; 273/160

[56] References Cited

U.S. PATENT DOCUMENTS

| | | | |
|---|---|---|---|
| 1,562,006 | 11/1925 | Sichterman | 446/106 |
| 1,890,269 | 12/1932 | Swanson | 446/115 |
| 2,278,327 | 3/1942 | Magnus et al. | 446/114 X |
| 2,931,130 | 4/1960 | Rietz | 446/115 |
| 3,701,214 | 10/1972 | Sakamoto | 446/115 |
| 3,819,188 | 6/1974 | Freedman | 273/160 |
| 4,270,304 | 6/1981 | Sofer | 446/124 X |
| 4,740,188 | 4/1988 | Coster | 446/106 X |
| 4,991,726 | 2/1991 | Johnson | 446/106 X |

FOREIGN PATENT DOCUMENTS

| | | | |
|---|---|---|---|
| 306715 | 2/1929 | United Kingdom | 446/113 |
| 607838 | 9/1948 | United Kingdom | 446/113 |
| 1034083 | 6/1966 | United Kingdom | 446/116 |

*Primary Examiner*—Robert A. Hafer
*Assistant Examiner*—D. Neal Muir
*Attorney, Agent, or Firm*—Morgan & Finnegan

[57] ABSTRACT

The present invention is comprised of a set of interlocking pieces whereby the base set of four different pieces provide extensive opportunity to assemble patterns two dimensionally and build three dimensionally. The unique asymmetrical mortise and tenon system allows for continual expansion of engaged forms by joining the pieces. The edge profile establishes a design criteria for developing different shaped pieces in addition to the four base pieces. The modular system of interlocking pieces takes advantage of the structural and spacial characteristics of reinforced concrete that other building configurations do not. This invention has the potential to be used for full scale construction as well as for an educational building toy.

8 Claims, 8 Drawing Sheets

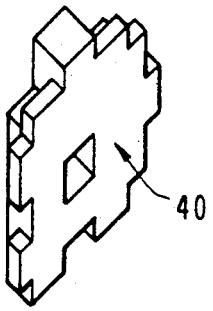
FIG. 4a
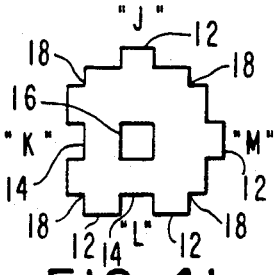
FIG. 4b
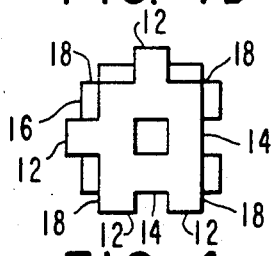
FIG. 4c
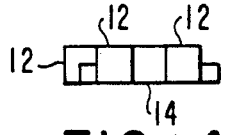
FIG. 4d
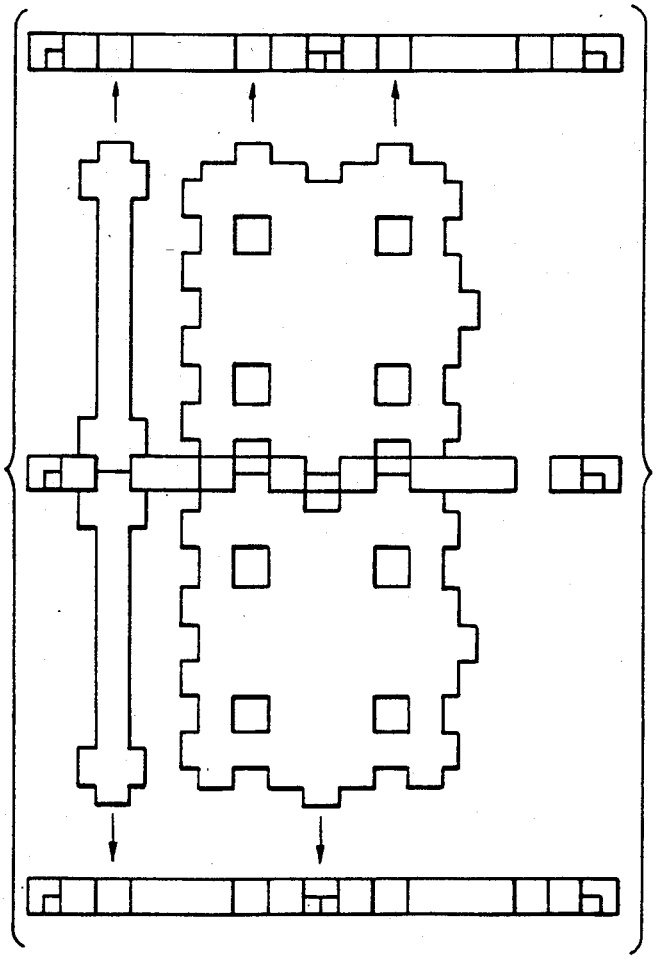
FIG. 5
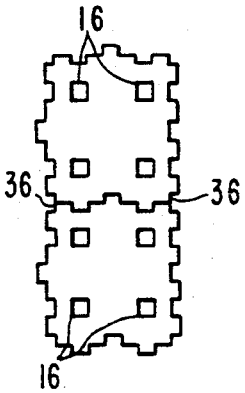
FIG. 6('A'-'B')
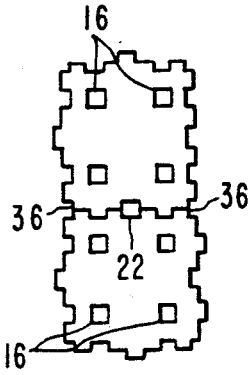
FIG. 7('B'-'C')
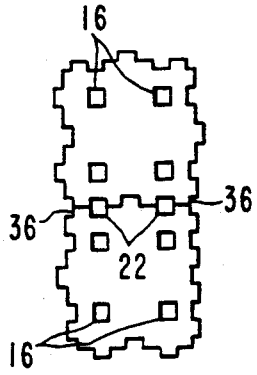
FIG. 8('A'-'C')
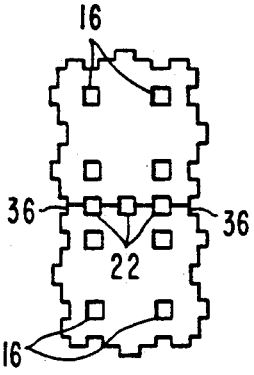
FIG. 9('C'-'C')

FIG. 27
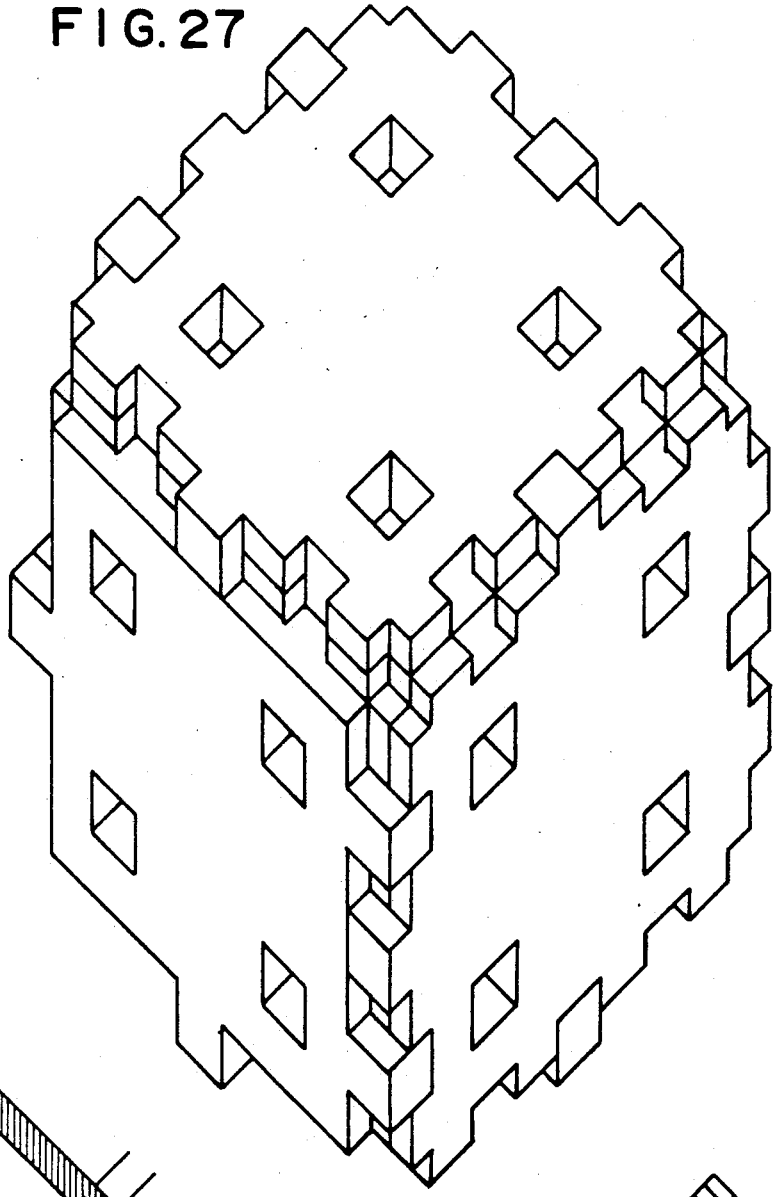
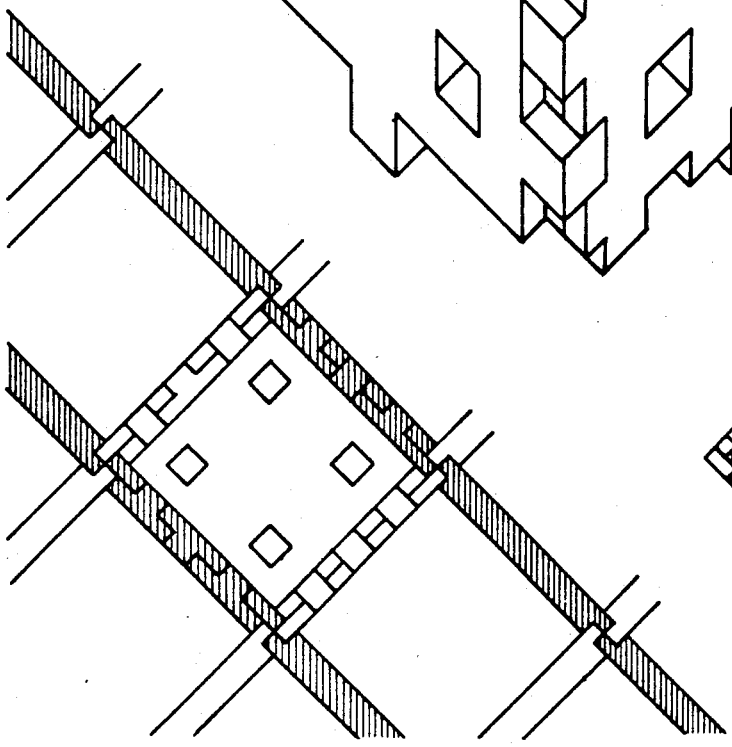
FIG. 29
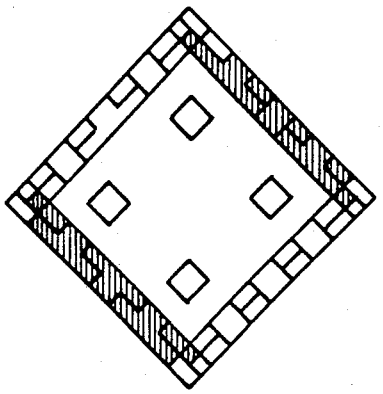
FIG. 28

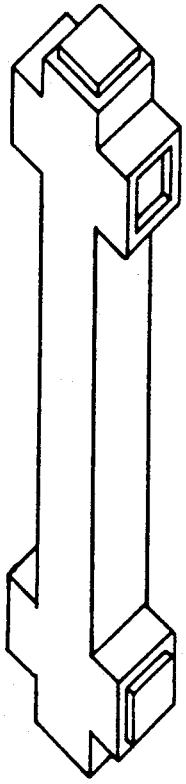
FIG. 31a
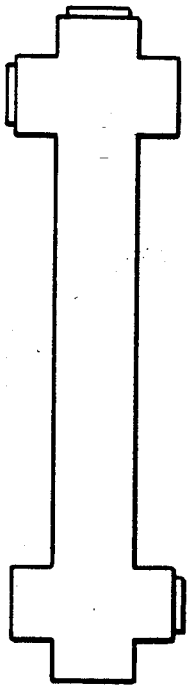
FIG. 31b
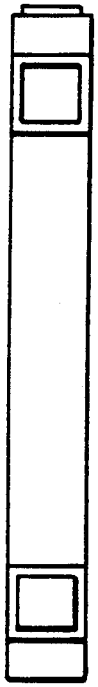
FIG. 31c
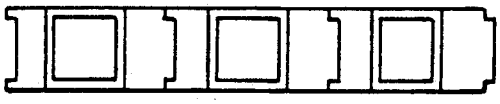
FIG. 31d
FIG. 32
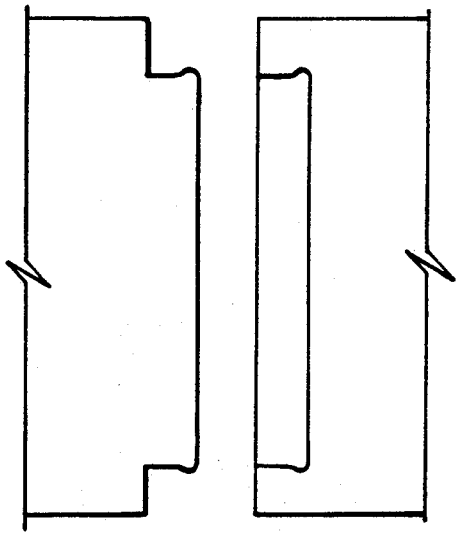

BUILDING BLOCK SET OF TENON ENGAGING EDGE CONNECTING MEMBERS

BACKGROUND OF THE INVENTION

The majority of building toys fall into three categories of full scale construction: masonry, wood, and steel. The success of Lego as the masonry, Lincoln-logs as the wood, and Erector-set as the steel system has influenced similar designs over the years. The above mentioned products and those that fall into similar categories lack a piece that can efficiently define a volume of space. Many bricks or logs need to be stacked to make a wall for a room, and many girders need to be assembled to define the skeletal perimeter of a space. A precast concrete slab can serve as a wall or as a floor slab for defining space in construction. Precast concrete as a modern building medium offers the compressive strength of masonry and the tensile strength of steel. As well, precast concrete exceeds the longevity of wood. Precast concrete has a counterpart of injection molded plastic in the miniature toy world. Both materials have a high strength to surface area ratio.

Several products and building block inventions have planar pieces that are comprised of interlocking slabs. Typically the toys have square pieces that are notched so that they can be joined with five other identical pieces to form a hollow cube. The following three inventions all have this characteristic: Toy Construction Block U.S. Pat. No. 1,894,061, Toy Construction Element U.S. Pat. No. 2,558,591, and Cuboidal Structure U.S. Pat. No. 3,924,376. The three above mentioned inventions can effectively form cubes, but in each case, the edge of the finished cube has a smooth interlocking fit that will not allow an additional piece to join on any side. The above mentioned inventions have pieces that can be joined two dimensionally indefinitely to make long square tubes, or they can be joined at right angles to form indefinite zigzag stairs. The invention here in described has the unique asymmetrical notched edge that enables one to make a cube that can then have two pieces join at each cube edge, making a total of up to 24 additional connecting pieces. The resulting four way connections give this invention the optimal construction flexibility for building three dimensionally. The invention enables a builder or a toy enthusiast to create simple volumes like a cube that can be embellished on increasingly more sophisticated levels. This invention enables the architect or engineer to design diverse large scale projects with a repeated modular system.

Precast concrete beams and columns are effectively used in construction because like the precast slab they are strong in both compression and tension. This invention includes a combination column and beam with ends that fit into the notch system of the square piece or two engaged pieces. The column end is designed to fit into half of the opening created by the slab piece so that a second column can fit into the same opening in the slab piece from the other side, see FIG. 5. This allows for a continual stacking of columns that intermittently support floor slabs at each level. The column piece, described in U.S. Pat. No. 1,562,006 Educational Building Construction Set, has protrusions that fill the entire cavity of the second piece and thus restrict continued construction from the opposite side. The one half notched pieces, described in U.S. Pat. No. 4,270,304 Flush-Fitting Toy Building Blocks, do not have a protrusion that can fit into secondary pieces to build vertically as columns.

SUMMARY OF THE INVENTION

In the invention described herein, the column has arms that serve as a pad to prevent the slab from slipping down the column. Not unlike precast concrete, the column piece can be turned horizontally to serve as a beam or lintel. Like the square piece, the column serves both a vertical and a horizontal purpose.

As an intermediate size between the square slab and the column, the rectangular piece incorporates the same notch system and has its own dual function. The rectangle turned vertically is a pier, either a wide column or a half wall. Turned horizontally the rectangular piece is a spandrel between floors of a building or a railing for a balcony. Two rectangular pieces linked side by side form the width of the large square piece. Like the column, the intermediate rectangular piece enhances the construction possibilities of the modular system.

The small square piece is a further breakdown of the modular system. The small square can serve as a column cap to support a floor slab or as a node to link several other pieces without enclosing a proportionally large plane of space. Two small square pieces linked at the edge form the length of the rectangular piece, and four small square pieces linked at the edge form the length and width of the large square piece.

By breaking down pre-conceptions that certain forms take on single function, this invention allows a wall to become a floor slab, a column to become a beam, and a pier to become a spandrel. The vast extent of diverse two and three dimentional configurations is possible through the unique notched edge configurations and the overall shapes of each piece.

BRIEF DESCRIPTION OF THE DRAWINGS

FIGS. 4*a*, 4*b*, 4*c*, and 4*d* are perspective, top, bottom, and side view of a fourth first construction unit of the present invention;

FIG. 5 is a partially exploded elevation view of two different construction units interconnected;

FIGS. 6, 7, 8, and 9 are top views of two like pieces assembled along different boarders;

FIG. 27 is a perspective view of six like pieces assembled into a cube;

FIG. 28 is a top view of six like pieces assembled into a cube;

FIG. 29 is a cut-away sectional view of like pieces intersecting at corners;

FIGS. 31*a*, 31*b*, 31*c*, and 31*d* are perspective, two sides, and top-bottom views of a construction unit similar in profile to FIGS. 3*a*–3*d*, and FIG. 31*d* is a top-bottom view of three like pieces assembled along the wide axis of the pieces.

FIG. 32 is a cut-away enlargement view showing the connection of the mortice and tenon on adjacent ends of FIG. 31.

DETAILED DESCRIPTION OF THE PREFERRED EMBODIMENTS

Figure 1A:
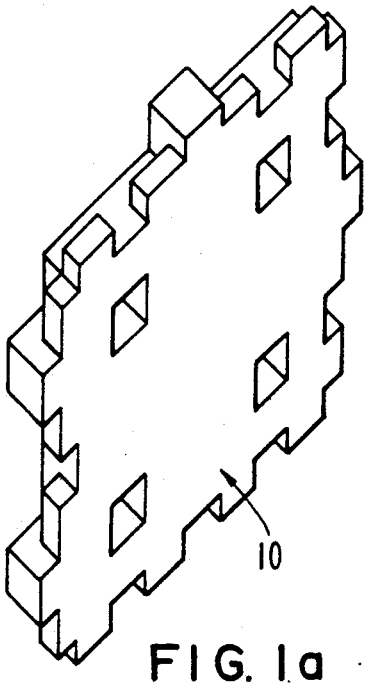
FIGS. 1*a*, 1*b*, 1*c*, and 1*d* are perspective, top, bottom, and side views of a first construction unit of the present invention.
Figure 2A:
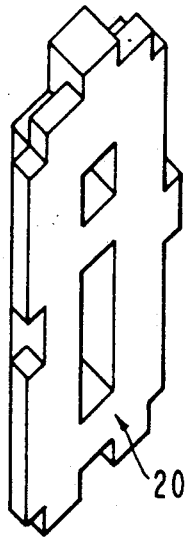
FIGS. 2*a*, 2*b*, 2*c*, and 2*d* are perspective, top, bottom, and side views of a second construction unit of the present invention.
Figure 3A:
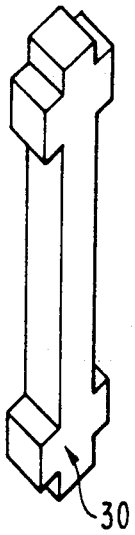
FIGS. 3*a*, 3*b*, 3*c*, and 3*d* are perspective, two sides, and top-bottom views of a third construction unit of the present invention.
Figure 1B:
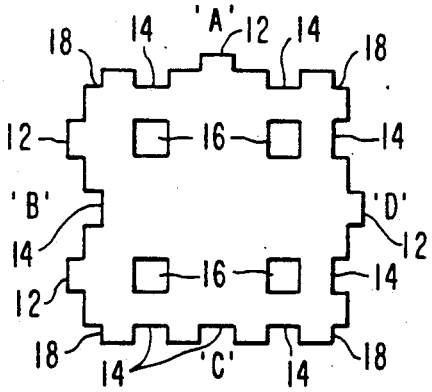
Figure 2B:
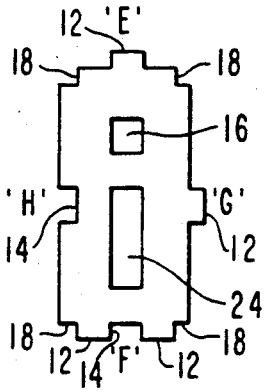
Figure 3B:
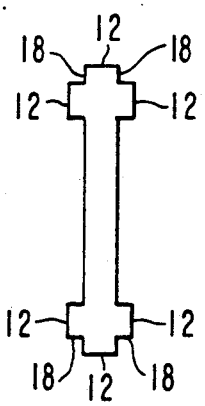
Figure 1C:
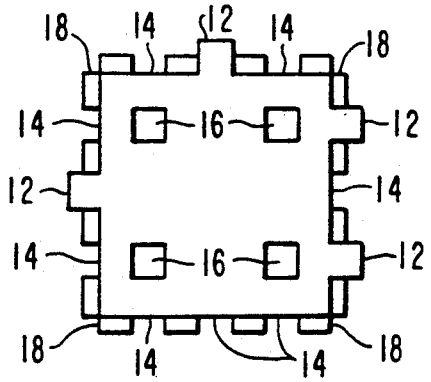
Figure 2C:
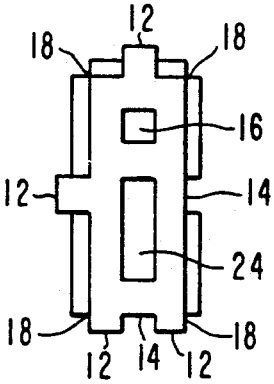
Figure 3C:
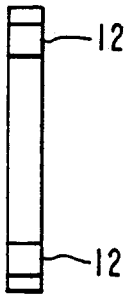
Figure 1D:
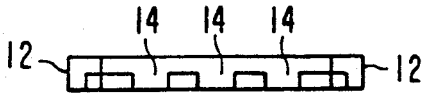
Figure 2D:
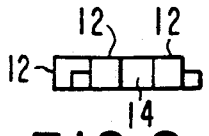
Figure 3D:
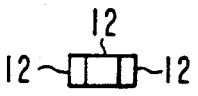

The Large Square Piece—FIGS. 1*a*, 1*b*, 1*c*, 1*d*

The primary building piece of said invention is the large square 10 which has an outside width of 9 times its thickness. In the perpendicular direction, the large square piece 10 has an outside height of 8½ times its thickness. The large square piece 10 has three different configurations of notches on its four sides. Two of the sides are identical. Side 'A' has one protrusion 12 and two cavities 14. Side 'B' has two protrusions 12 and one cavity 14. Side 'C' has three cavities 14 and no protrusions. Side 'D' is identical to side 'A' with one protrusion 12 and two cavities 14. The cavities are ½ as deep as they are wide; in volume they are ½ cubes. The protrusions are ½ as tall as they are wide; in volume they are ½ cubes. The protrusions fill the entire space of the edge cavities if two pieces are joined in either a parallel or perpendicular plane.

The Large Square Piece in the Two Dimensional Plane

Figure 10:
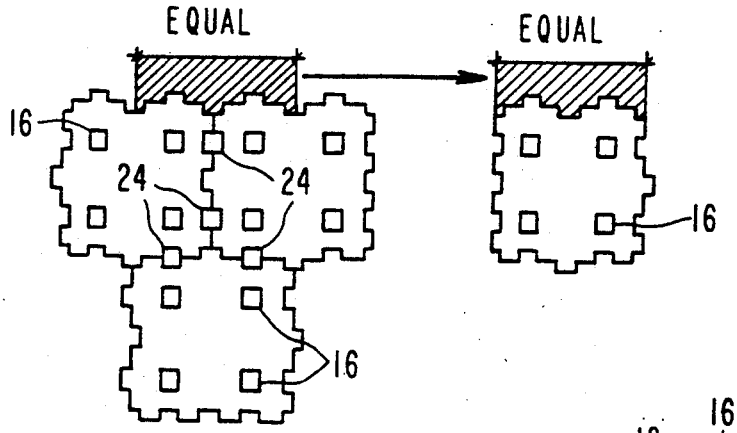
FIG. 10 is an explanatory top view of the repeating boarder condition of linked pieces.

In a parallel two dimensional plane, if side 'A' of one piece 10 is joined with side 'B' of another piece 10 along their communal center line, the combination will fill the openings along the connecting edge, see FIG. 6. If side 'A' of one piece 10 is joined with side 'C' of another piece 10 along their communal center line, the combination will provide two full cube openings 22, see FIG. 8. If side 'A' of one piece 10 is joined with side 'A' pf another piece 10 the sides will touch at the one center protrusion. The two pieces 10 can connect if one of them is shifted to the right or to the left of their communal center lines. If the second piece 10 is shifted off center it will also enable a third piece 10 to join the original side 'A'. The third piece 10 can be connected to both the first and the second pieces, see FIG. 10.

Figure 12:
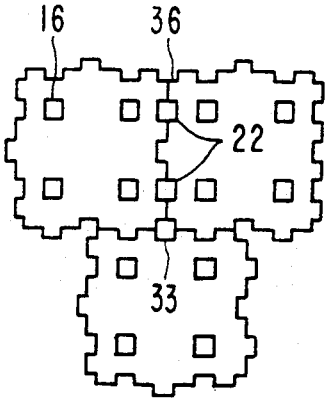

In a parallel two dimensional plane, if side 'B' of one piece 10 is joined with side 'C' of another piece 10 along their communal center line, the combination will provide one opening 22, see FIG. 7. If side 'B' of one piece 10 is joined with side 'B' of another piece 10, the sides will touch at the two protrusion points. The two pieces can connect if the second one is shifted to the right or to the left of their communal center line. If the second piece 10 is shifted off center it will enable a third piece 10 to join the original side 'B'. The third piece 10 can be connected to both the first and the second pieces, see FIG. 12.

Figure 11:
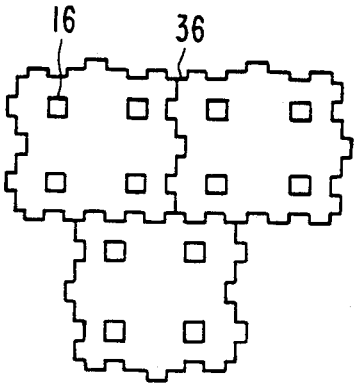
FIGS. 11, 12, 13, and 14 are top views of like pieces assembled in different configurations.

In a parallel two dimensional plane, if side 'C' of one piece 10 is joined with side 'C' of another piece 10 along their communal center line, the sides will touch at the three protrusion points and provide three openings 22, see FIG. 9. The two pieces 10 can join if the second one is shifted to the right or to the left of their communal center line. If the second piece 10 is shifted off center it will enable a third piece to join the original side 'C'. The third piece 10 can be joined to both the first and the second pieces, see FIG. 11. As well, the assembly produces a full cube cavity 33 at the intersection of the three pieces.

Figure 13:
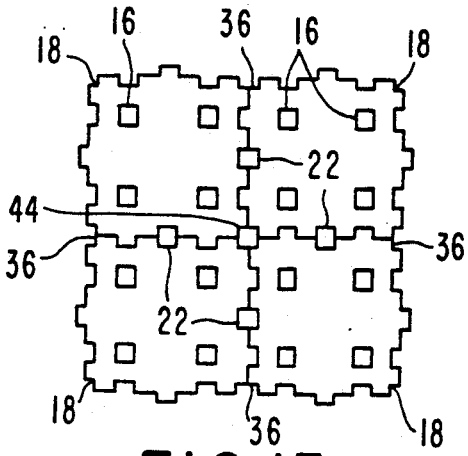
Figure 14:
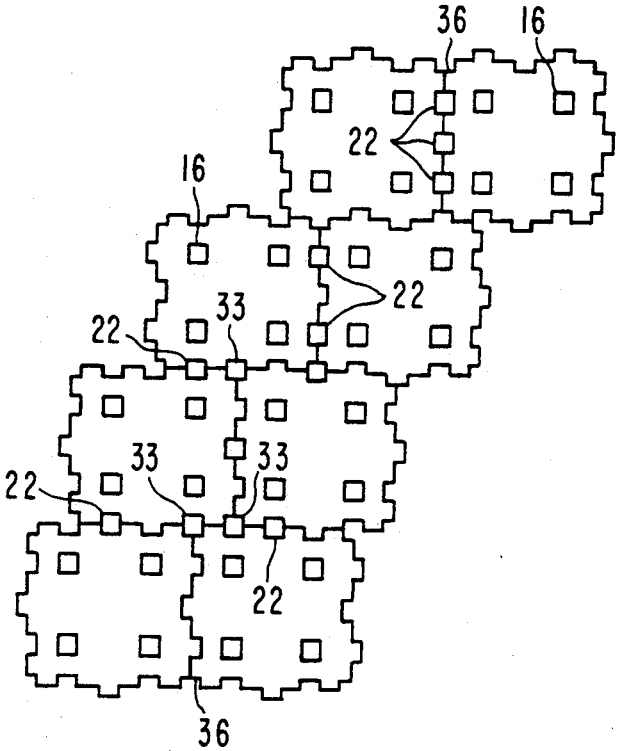
Figure 15:
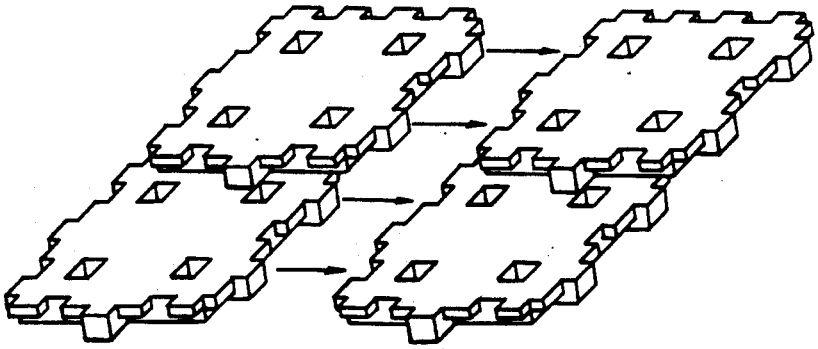
FIG. 15 is an exploded perspective view of four like pieces interconnected.
Figure 16:
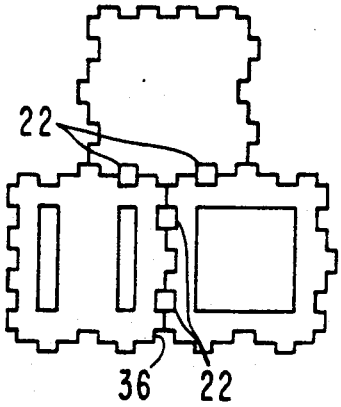
FIG. 16 is a top view of different internal configurations of three pieces with like profiles.

In a parallel two dimensional plane, if any of the pieces 10 are joined along the communal centerline, the joined edge will always form a typical ½ cube cavity 36 at either end of the joint lines. The composite cavity 36 is identical in size to the individual cavity 14, differing only in the central score line. Each of the four sides of piece 10 has a ¼ notch 18 at the corners so that when two pieces 10 are joined they may create the ½ cube cavity 36 at the connection point; when four pieces 10 are joined they form a full cube cavity 44, see FIG. 13. The corner notches 18 allow for expansion of the system on the two dimensional plane, because a positive piece fits into the combination of two ¼ notches. The pieces can be grouped and rotated like a puzzle forming patterns that can be expanded indefinitely. The notches also provide holes in the two dimensional plane so that secondary pieces can be joined at a perpendicular angle to the primary pieces. The laying out of a mat like surface on the horizontal plane provides the basis for a playboard to begin using the three dimensional capabilities of this invention, see FIGS. 14 and 15. The playboard can have a different arrangement of holes on every use and can expand indefinitely. For the purposes of a puzzle as a young child's learning toy, the pieces will have different colors and textures to encourage turning the pieces and investigating the potential of the different notch configuration on each side. As well, the pieces can have different opening configurations within the perimeter of the piece, see FIG. 16. The internal opening size and location variations are restricted to either full or ½ the thickness of the piece. The varied openings expand the potential for diverse configurations.

The Three Dimensional Potential of the Large Square Piece

Figure 30:
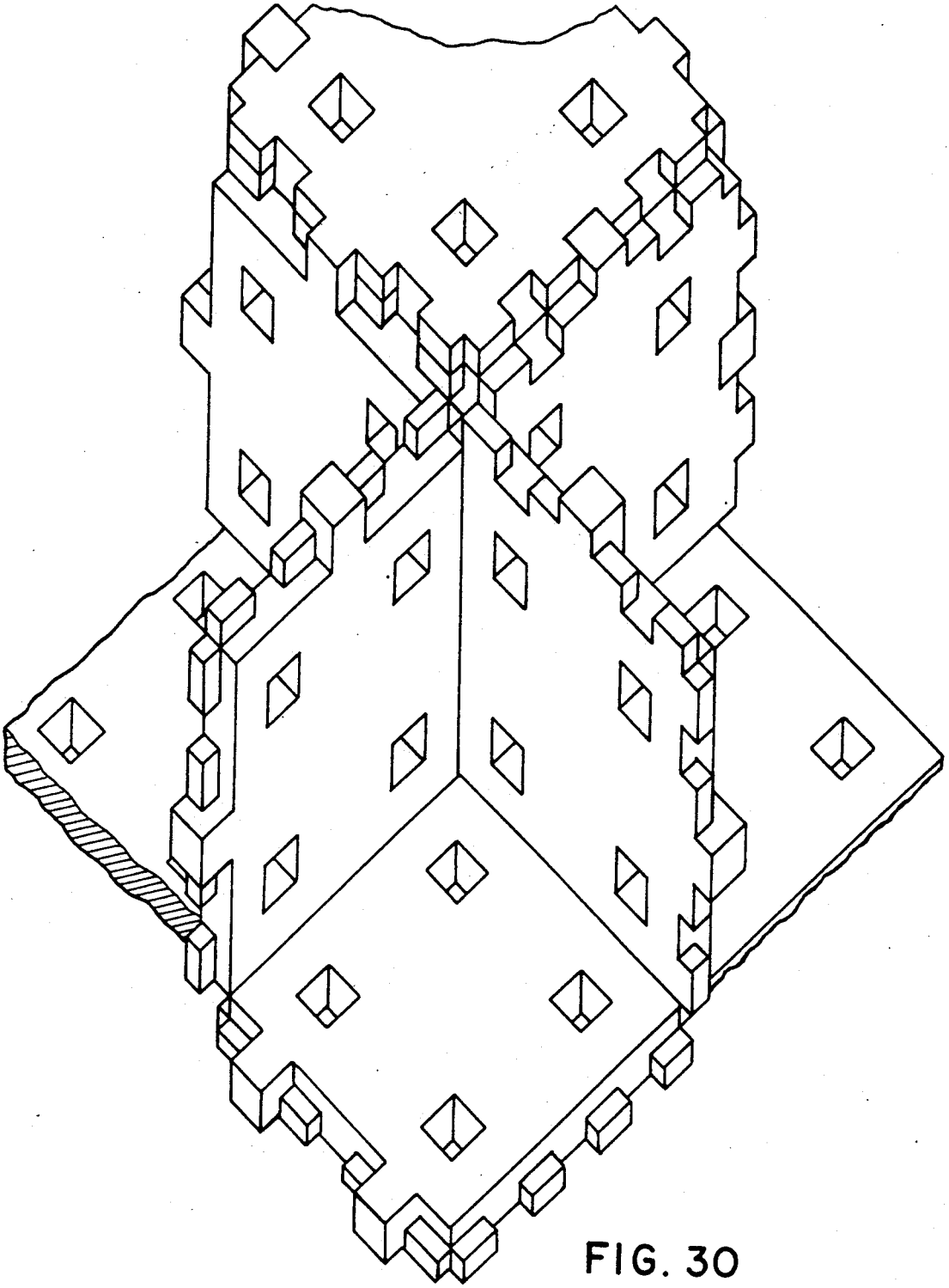
FIG. 30 is a perspective view of like pieces intersecting at the corner of an assembled cube.

One large square piece 10 can join perpendicular to as well as parallel to a second large square piece 10. Two pieces 10 oriented vertically can be inserted into the holes created by the arrangement of horizontal pieces 10 so that they stand like two "walls" parallel to each other 7 spaces apart (one space is defined as the width of said unit). The vertical pieces 10 can be joined at the top by additional horizontal "roof" pieces. The process can continue indefinitely both vertically and horizontally, see FIG. 5. Two pieces 10 oriented vertically can be inserted into the holes created by the arrangement of horizontal pieces so that they stand perpendicular to each other and join at the shared corner. Two more vertical pieces 10 can be inserted to complete a square that is connected at its four corners and at the base, see FIG. 28. A third pair of vertical pieces can join to the outside corner of the square and also anchor into the horizontal pieces. The resulting four way connection of the last configuration is possible because the protrusions are ½ as tall as they are wide and the notch is ½ as deep as it is wide. Two notches abutting each other form a hollow cube that accommodates two abutting protrusions. To connect the pieces at the corners, the orientation of each piece is rotated to accomodate the different notches and protrusions. Given four pieces 10 joined at their corners, a fifth and sixth piece 10 can be added to create a cube, see FIG. 27. The invention is designed so that six identical pieces 10 can form a cube. Additional pieces can be attached to each edge of the cube, see FIGS. 29 and 30.

The four holes 16 in the large square piece are for additional flexibility in construction. The holes 16 are three spaces apart on piece 10. The holes 16 are one space away from the closest edge of piece 10. A protrusion 12 from any of the pieces fills half of hole 16 in the large square piece 10. Side 'B' of piece 10 has two protrusions spaced to fit into the two holes of another piece 10, see FIG. 5. If sides 'A' and 'C' of two different pieces are joined the profile of one edge of the rectangular shape will be identical to two side 'B's, see FIG. 10. The double side 'B' will have a total of four notches, and the two center notches can fit into the holes three spaces apart as well as the pairs of outside notches. The holes can serve to join two perpendicular pieces which are also joined to each other. Any of the other sides can be oriented in the same direction to repeat the pattern of one of the sides. For example, If side 'C' is repeated along a continuous line, the profile will be a saw tooth of notches every other space. At the intersection of the pieces, the notch will have a joint at the center of the notch.

If any of the protrusions are inserted in the holes created by the joining of two or more pieces, or if they are inserted in one of the permanent holes centered on the piece itself, the protrusions will only fill one half of the hole. The other unfilled half of the hole is designed to accommodate a protrusion of a third piece from the opposite side. The continual leaving of a half open hole allows architoy to expand indefinitely both two and three dimensionally, see FIG. 5.

The Rectangular Piece-FIG. *2a, 2b, 2c, 2d*

The rectangular piece 20 of this invention is also asymmetrical like the large square piece 10. The rectangular piece 20 uses the same notch principle piece 10, so it can be used as a building tool in itself. The rectangular piece 20 at its outside length is 8½ times its thickness. The rectangular piece 20 at its outside width is 4½ times its thickness. On the two short sides 'E' and 'F', the rectangular piece 20 has one protrusion 12 on side 'E' and one notch 14 on side 'F' which is flanked by two protrusions 12. On the two long sides 'G' and 'H', the rectangular piece 20 has one protrusion 12 on side 'G' and one notch 14 on side 'H'. The rectangular piece 20 has one hole 16 and one slot 24 in the center of the piece. The hole is 1½ spaces away from side 'G' and 'H', and 2 spaces away from side 'E'. The slot is three spaces long and one space wide. Both the hole and the slot are one space deep, the thickness of said piece. The slot is located one space away from the hole, 1½ space away from side 'F', 'G' and 'H'. At the notched portion of side 'F' and side 'H', the slot is one spaces away from the inside of the notch. At the protrusion portion of side 'G', the slot is two spaces away from the outer edge of the protrusion.

The Rectangular Piece in the Two Dimensional Plane

Figure 17:
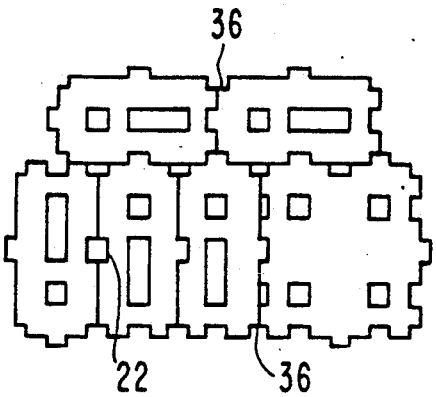
FIGS. 17, 18, and 19 are top views of construction units assembled in different configurations.
Figure 26:
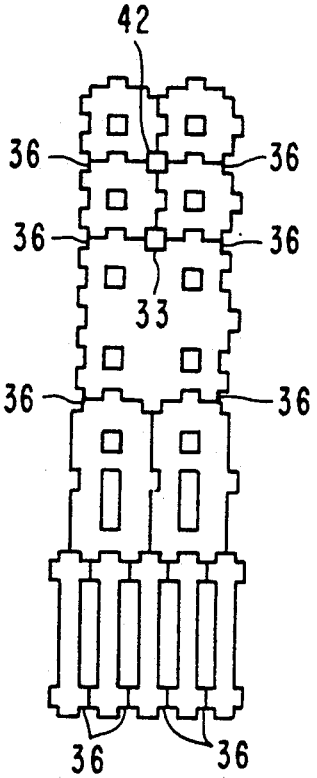
FIG. 26 is a top view of several interconnected pieces of different configurations.

In the two dimensional plane, two rectangular pieces 20 joined side by side to form the width of a large square piece 10, see FIGS. 17 and 26. Side by side, the rectangular pieces join by attaching 'G' to 'H'. The connection forms a different overall profile from the large square piece 10. The adjacent short ends 'F' and 'F' match side 'B' with two protrusions three spaces apart. The adjacent short ends 'E' and 'E' match side 'C' of the large square piece 10 which has three notches. The paired configuration of the two rectangular pieces 20 has a center notch with a seam down the middle where the two pieces touch each other. The remaining two sides of the configuration are different than the sides of the square pieces but are equal in overall length. Up and down, or long ways, the rectangular pieces join by attaching 'F' to 'E'. Perpendicular to each other, 'F' fits into 'G', and 'H' fits into 'E'. In all of the above connections, the protrusion fits the notch leaving no hole.

If side 'F' is butted up to side 'F' of another piece 20 or side 'H' is butted up to side 'H' of another piece 20 the pieces will touch and a square hole 22 will be formed, see FIG. 17. If side 'F' is joined in a parallel plane with side 'E', a third piece 20 can be oriented perpendicular to the first two so that one of the protrusions 12 can fit into either of the notches 18 created at the joint of 'E' and 'F', see FIG. 17. Just as the large square piece 10 can repeat itself on a double staggered system so too can the rectangular piece. For the purposes of pattern making, the rectangular pieces can be turned and connected in a variety of ways. The holes created at the corners of the connections, and the holes and slots within the pieces themselves provide for a building mat to expand three dimensionally.

The Three Dimensional Potential of the Rectangular Piece

Figure 18:
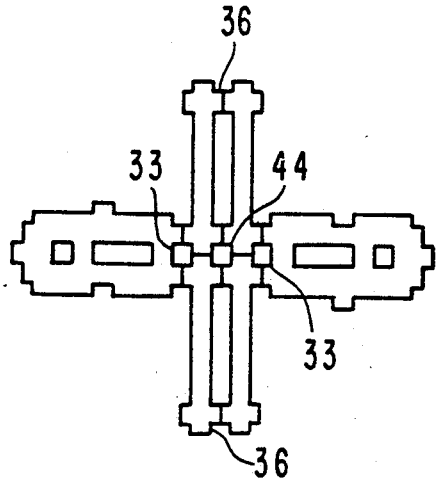
Figure 19:
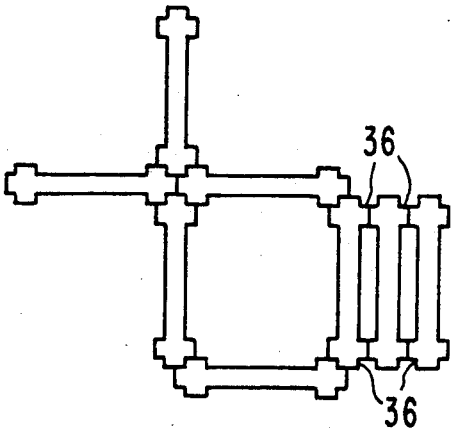
Figure 20:
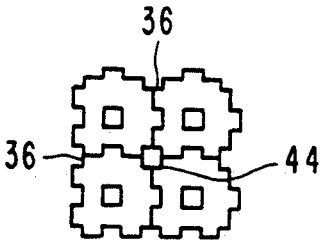
FIGS. 20, 21, 22, 23, and 24 are top views of four like pieces assembled along different borders.
Figure 21:
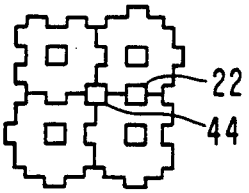
Figure 22:
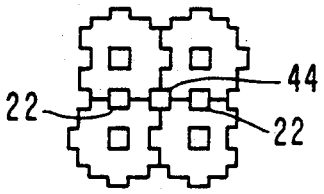
Figure 23:
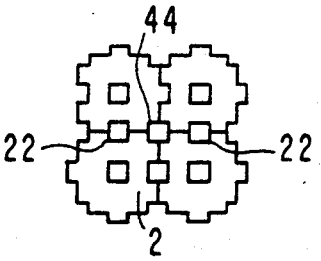
Figure 24:
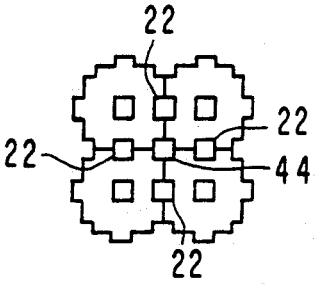
Figure 25:
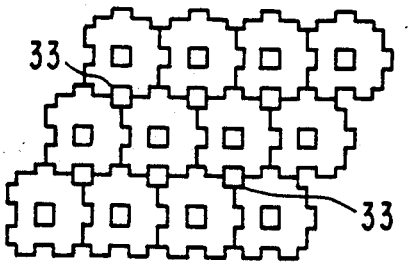
FIG. 25 is a top view of twelve like pieces assembled in a staggered relationship to each other.

The rectangular piece 20 shares the three dimensional advantages of the large square piece 10 in its ability to fit vertically into openings in the horizontal plane. Four rectangular pieces can form a square tube and either end can be capped by a small square piece 40 to form a hollow rectangular volume. To from the hollow rectangular volume two of the four rectangular pieces must be inverted so that the protrusions match the cavities provided by the repeated along a straight path or it could be staggered in any direction. If two pairs of the parallel longitudinal formations touch each other at either of the short ends, a central hole will be formed at the four way intersection, see FIG. 18. The hole like the holes formed by the arrangement of the square and the rectangular pieces provide the opportunity for vertical or three dimensional expansion.

The Three Dimensional Potential of the Column Piece

The column piece 30 can fit into the hole created by the connection of four horizontal pieces. If the horizontal pieces form an additional hole at the other short end then another vertical piece can be added. The two vertical pieces now standing like two columns that can be bridged at the top by an additional horizontal piece, see FIG. 5. Bridging at the top can occur if the piece is rotated so that the flanking protrusions stick either up or out. Additional columns can be bridged by additional lintels and the structure can take on a skeletal or scaffold like form that can expand indefinitely.

The Small Square Piece—FIG. 4*a*, 4*b*, 4*c*, 4*d*

The small square piece 40 has an outside width of 4½ times its thickness. In the perpendicular direction, the small square piece 40 has an outside height of 4½ times its width. The small square piece 40 has three different configurations of notches on its four sides. Sides 'J' and 'M' are identical with a single protrusion 12 on each. Side 'K' has a single notch and side 'L' has a single notch flanked by two protrusions. On the back side of 'L', the flanking members of the notch are the full thickness of the piece while on side 'K' they are only half as thick. Side 'L' of the small square piece 40 is identical to side 'F' of the rectangular piece 20, and sides 'J' and 'M' of the small square piece 40 are identical to side 'E' of the rectangular piece 20.

The Small Square Piece in the Two Dimensional Plane

Two of the small square pieces 40 joined so that the protrusion fits into the notch will form the height of the rectangular piece 20 in the 'E'-'F' direction and the height of the large square piece 10 in the 'A'∝1 C' direction, see FIG. 26. Four of the small square pieces 40 joined so that the protrusions fit into the notches can form the height and width of the large square piece 10 and the perimeter configuration of two of the four sides of piece 10.

Four small square pieces 40 can be arranged in different configurations to provide 5, 6, 7, 8, or 9 holes, see FIGS. 20–24. If the small square pieces do not have central holes then the configurations of FIGS. 20–24 provide 1, 2, 3, 4, or 5 holes.

The Three Dimensional Potential of the Small Square Piece

Six small square pieces 40 can join to form a hollow cube. Additional pieces 40 can join to the edges of the cube to expand the building system. The hole in the center of the small square piece 40 provides additional building flexibility. The hole can receive the protrusion of a second small square or the protrusion 12 from any of other pieces.

Three Dimensional Potential of All Three Pieces

Individually each of the four pieces 10, 20, 30, and 40 offer two dimensional patterning opportunities and three dimensional structural potential. Paired with one or more of the other pieces, this invention offers expanded spacial opportunities. The combination of all four compatible pieces gives the master builder extensive flexibility in construction. This invention does not designate a specific material for fabrication of the pieces. The successful joining of the notches will depending on a variety of factors including the density of the material, the thermal expansion and contraction of the material, the tolerance capability of the fabrication process, and the thickness of the pieces. This invention can adapt a fastening device similar to the one illustrated in FIG. 31 and 32 not only to ensure snug fitting connections but also to enable two opposing protrusion ends to attach for further flexibility in construction. This invention is also highly suited for computer generated imagery which offers a construction environment void of both friction and gravity.

While this invention has been described and illustrated in the best forms known, it will nevertheless be understood that this is purely exemplary and that additional shapes of pieces may incorporate the same interlocking edge condition and modifications may be made without departing from the spirit of the invention.

What is claimed is:

1. A building block set comprising:

a plurality of first block members, each having first and second major planar surfaces parallel to each other defining a substantially uniform thickness and having four mutually orthogonal sides defining four corners, each side having a plurality of half thickness rectangular protrusions forming at least one rectangular notch having a width approximately the thickness of the first block member, and at least two sides having at least one full thickness protrusion, said half thickness protrusions forming an L-shaped notch on each corner having a length and width approximately half the thickness of the first block member, the protrusions and notches of one first block member being adapted to be interfitted with protrusions and notches of other first block members to form various structures.

2. A building block set according to claim 1, further comprising at least one square hole extending through the first block member from the first to the second major planar surface, each square hole having a length and width approximately the width and thickness of the full thickness protrusions.

3. A building block set according to claim 2, wherein the thickness of the first block member is approximately twice the length of the notches and protrusions.

4. A building block set according to claim 3, wherein the square hole has a length and width approximately equal to the thickness of the first block member.

5. A building block set according to claim 1, wherein two adjacent sides have one full thickness protrusion flanked by two half thickness notches and a third side has one full thickness notch flanked by two half thickness protrusions.

6. A building block set according to claim 1, wherein two adjacent sides have one full thickness protrusion each and the two other sides have one notch each.

7. A building block set according to claim 1, further comprising at least one beam member having first and second opposite ends, either end being interfitted with one of the plurality of first block members at a right angle to the first and second major planar surfaces thereof.

8. A building block set according to claim 7, wherein the beam member has a tenon formed at each end, the tenon having a length and width equal to the length and width of the full thickness protrusions of the first block member.

* * * * *